US010581169B2

(12) United States Patent
Kim et al.

(10) Patent No.: US 10,581,169 B2
(45) Date of Patent: Mar. 3, 2020

(54) ANTENNA DEVICE AND ELECTRONIC DEVICE INCLUDING THE SAME

(71) Applicants: Samsung Electronics Co., Ltd., Gyeonggi-do (KR); Industry-Academic Cooperation Foundation, Yonsei University, Seoul (KR)

(72) Inventors: Sung-Soo Kim, Gyeonggi-do (KR); Young-Joong Yoon, Seoul (KR); Seon-Ho Lim, Seoul (KR)

(73) Assignees: Samsung Electronics Co., Ltd (KR); Industry-Academic Cooperation foundation, Yonsei University (KR)

( * ) Notice: Subject to any disclaimer, the term of this patent is extended or adjusted under 35 U.S.C. 154(b) by 0 days.

(21) Appl. No.: 16/020,387

(22) Filed: Jun. 27, 2018

(65) Prior Publication Data

US 2019/0067821 A1 Feb. 28, 2019

(30) Foreign Application Priority Data

Aug. 25, 2017 (KR) ..... 10-2017-0107845

(51) Int. Cl.

| | |
|---|---|
| ***H01Q 1/24*** | (2006.01) |
| ***H01Q 9/04*** | (2006.01) |
| ***H01Q 7/00*** | (2006.01) |
| ***H01Q 5/371*** | (2015.01) |
| ***H01Q 3/24*** | (2006.01) |
| *H01Q 21/00* | (2006.01) |
| *H01Q 5/50* | (2015.01) |

(52) U.S. Cl.

CPC ..... *H01Q 9/0421* (2013.01); *H01Q 1/243* (2013.01); *H01Q 3/247* (2013.01); *H01Q 5/371* (2015.01); *H01Q 7/00* (2013.01); *H01Q 3/24* (2013.01); *H01Q 5/50* (2015.01); *H01Q 21/00* (2013.01)

(58) Field of Classification Search

CPC ..... H01Q 1/243; H01Q 3/24; H01Q 5/50; H01Q 21/00

USPC ..... 343/702, 700, 876, 853, 724, 725

See application file for complete search history.

(56) References Cited

U.S. PATENT DOCUMENTS

| | | | | |
|---|---|---|---|---|
| 6,204,819 B1 * | 3/2001 | Hayes | ..... | H01Q 1/243 343/700 MS |
| 2002/0190907 A1 * | 12/2002 | Konishi | ..... | H01Q 1/243 343/702 |

* cited by examiner

*Primary Examiner* — Joseph J Lauture

(74) *Attorney, Agent, or Firm* — The Farrell Law Firm, P.C.

(57) ABSTRACT

An antenna device is provided. The antenna device includes a first radiating conductor including a feeding portion and a radiating portion extending from the feeding portion, the feeding portion including a feeding terminal and a shorting pin, a ground electrically connected with the first radiating conductor via the shorting pin and configured to provide a reference potential for the first radiating conductor, and a first switch circuit provided on a side of the radiating portion and configured to selectively connect the radiating portion with the ground. The first radiating conductor is configured to form at least part of an inverted-F antenna structure when the first switch circuit is open and to form at least part of a loop antenna structure when the first switch circuit is closed.

19 Claims, 5 Drawing Sheets

ANTENNA DEVICE AND ELECTRONIC DEVICE INCLUDING THE SAME

CROSS-REFERENCE TO RELATED APPLICATION(S)

This application is based on and claims priority under 35 U.S.C. § 119(a) to Korean Patent Application Serial No. 10-2017-0107845, filed on Aug. 25, 2017, in the Korean Intellectual Property Office, the entire disclosure of which is incorporated herein by reference.

BACKGROUND

1. Field

The present disclosure relates, generally, to electronic devices, and, more particularly, to electronic devices with antenna devices.

2. Description of Related Art

Electronic devices may perform wireless communication via their equipped antennas. Electronic devices may come with a diversity of antenna devices, such as antennas for near-field communication (NFC) for wireless charging or electronic card features, antennas for accessing a local area network (LAN), and antennas for accessing commercial communication networks. As such, an electronic device may be equipped with various antenna devices, ensuring the optimal communication environment by choosing an adequate one of the antenna devices depending on its use environment or operation mode.

Meanwhile, adoption of carrier aggregation (CA) technology provides concurrent communication in multiple different frequency bands, implementing high-rate, high-volume wireless communication. It may deliver real-time transmission of ultra high-definition videos to users. Such high-rate, high-volume wireless communications may be achieved by electronic devices of service providers with appropriate antenna devices.

The more frequency bands are made available, the easier CA technology can be implemented. However, securing more frequency bands for use in communication environments requires an additional antenna device. Mobile communication terminals or other compact electronic devices to which portability matters may have difficulty in securing extra space in which to carry more antenna devices.

SUMMARY

The present disclosure has been made to address at least the disadvantages described above and to provide at least the advantages described below.

Accordingly, an aspect of the present disclosure provides an antenna device and/or an electronic device with such antenna devices that are utilized to secure a resonance frequency in multiple different frequency bands even in a small space.

An aspect of the present disclosure provides an antenna device and/or an electronic device with such an antenna device that alleviates work overload due to redesigning the arrangement while securing additional frequency bands for use in communication environments.

In accordance with an aspect of the disclosure, there is provided an antenna device. The antenna device includes a first radiating conductor including a feeding portion and a radiating portion extending from the feeding portion, the feeding portion including a feeding terminal and a shorting pin, a ground electrically connected with the first radiating conductor via the shorting pin and configured to provide a reference potential for the first radiating conductor, and a first switch circuit provided on a side of the radiating portion and configured to selectively connect the radiating portion with the ground. The first radiating conductor is configured to form at least part of an inverted-F antenna structure when the first switch circuit is open and to form at least part of a loop antenna structure when the first switch circuit is closed.

In accordance with an aspect of the disclosure, there is provided an electronic device. The electronic device includes a casing member including a side wall, the side wall at least partially including an electrically conductive material and an antenna device configured to transmit or receive a wireless signal. The antenna device includes a first radiating conductor formed as a portion of the side wall, a ground configured to provide a reference potential for the first radiating conductor, a feeding terminal disposed at or adjacent a first end of the first radiating conductor, a first switch circuit disposed at or adjacent a second end of the first radiating conductor and configured to selectively connect the first radiating conductor to the ground, and a shorting pin disposed adjacent the feeding terminal between the feeding terminal and the second end of the first radiating conductor and configured to electrically connect the first radiating conductor to the ground. The first radiating conductor is configured to form at least part of an inverted-F antenna structure when the first switch circuit is open and to form at least part of a loop antenna structure when the first switch circuit is closed.

BRIEF DESCRIPTION OF THE DRAWINGS

The above and other aspects, features and advantages of certain embodiments of the disclosure will be more apparent from the following detailed description taken in conjunction with the accompanying drawings, in which.

DETAILED DESCRIPTION

Figure 1:
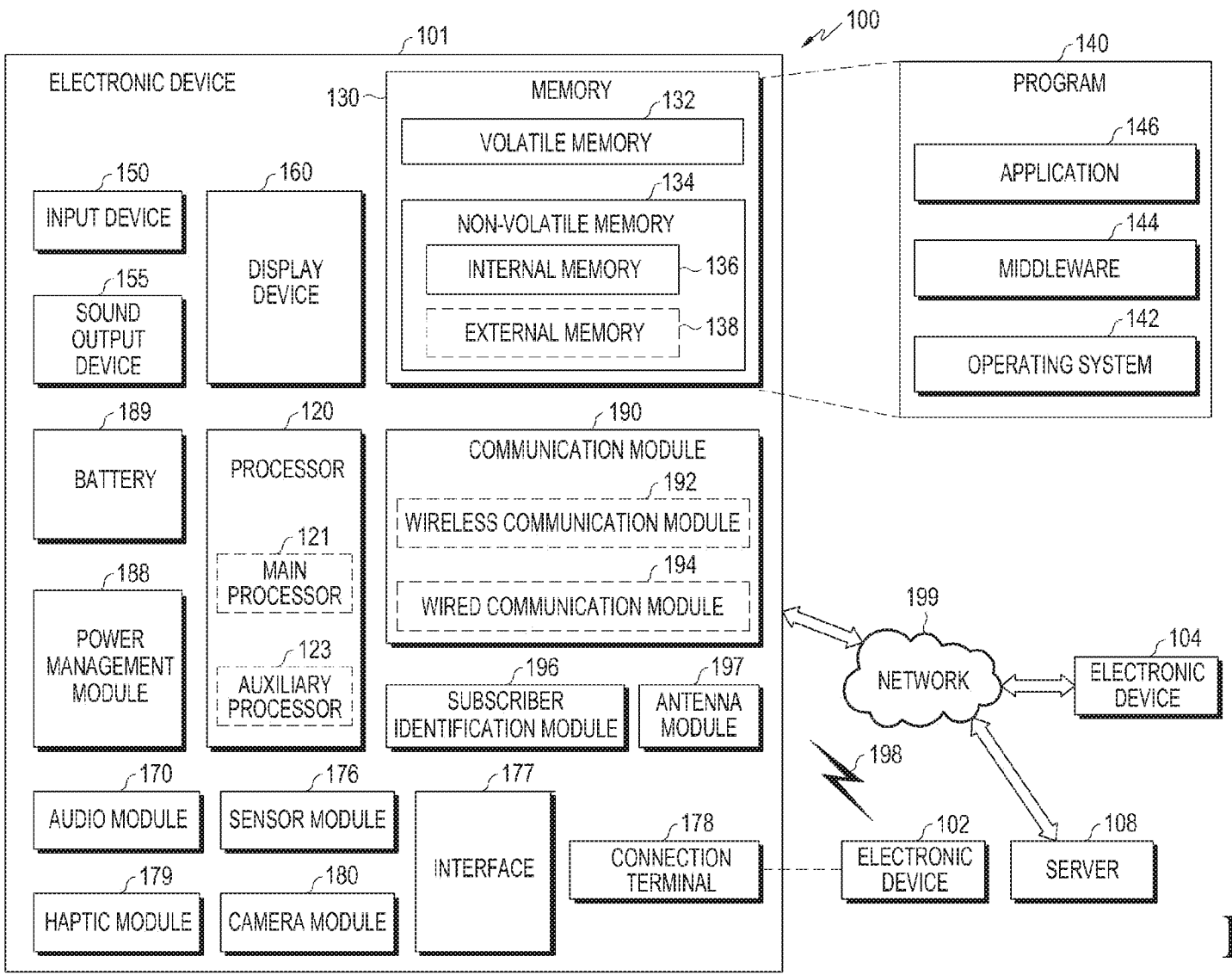
FIG. 1 is a diagram of an electronic device in a network environment, according to an embodiment.

Embodiments of the disclosure will be described herein below with reference to the accompanying drawings. However, the embodiments of the disclosure are not limited to the specific embodiments and should be construed as including all modifications, changes, equivalent devices and methods, and/or alternative embodiments of the present disclosure. In the description of the drawings, similar reference numerals are used for similar elements.

The terms "have," "may have," "include," and "may include" as used herein indicate the presence of corresponding features (for example, elements such as numerical values, functions, operations, or parts), and do not preclude the presence of additional features.

The terms "A or B," "at least one of A or/and B," or "one or more of A or/and B" as used herein include all possible combinations of items enumerated with them. For example, "A or B," "at least one of A and B," or "at least one of A or B" means (1) including at least one A, (2) including at least one B, or (3) including both at least one A and at least one B.

The terms such as "first" and "second" as used herein may use corresponding components regardless of importance or an order and are used to distinguish a component from another without limiting the components. These terms may be used for the purpose of distinguishing one element from another element. For example, a first user device and a second user device may indicate different user devices regardless of the order or importance. For example, a first element may be referred to as a second element without departing from the scope the disclosure, and similarly, a second element may be referred to as a first element.

It will be understood that, when an element (for example, a first element) is "(operatively or communicatively) coupled with/to" or "connected to" another element (for example, a second element), the element may be directly coupled with/to another element, and there may be an intervening element (for example, a third element) between the element and another element. To the contrary, it will be understood that, when an element (for example, a first element) is "directly coupled with/to" or "directly connected to" another element (for example, a second element), there is no intervening element (for example, a third element) between the element and another element.

The expression "configured to (or set to)" as used herein may be used interchangeably with "suitable for," "having the capacity to," "designed to," "adapted to," "made to," or "capable of" according to a context. The term "configured to (set to)" does not necessarily mean "specifically designed to" in a hardware level. Instead, the expression "apparatus configured to . . . " may mean that the apparatus is "capable of . . . " along with other devices or parts in a certain context. For example, "a processor configured to (set to) perform A, B, and C" may mean a dedicated processor (e.g., an embedded processor) for performing a corresponding operation, or a generic-purpose processor (e.g., a central processing unit (CPU) or an application processor (AP)) capable of performing a corresponding operation by executing one or more software programs stored in a memory device.

The terms used in describing the various embodiments of the disclosure are for the purpose of describing particular embodiments and are not intended to limit the disclosure. As used herein, the singular forms are intended to include the plural forms as well, unless the context clearly indicates otherwise. All of the terms used herein including technical or scientific terms have the same meanings as those generally understood by an ordinary skilled person in the related art unless they are defined otherwise. The terms defined in a generally used dictionary should be interpreted as having the same or similar meanings as the contextual meanings of the relevant technology and should not be interpreted as having ideal or exaggerated meanings unless they are clearly defined herein. According to circumstances, even the terms defined in this disclosure should not be interpreted as excluding the embodiments of the disclosure.

The term "module" as used herein may, for example, mean a unit including one of hardware, software, and firmware or a combination of two or more of them. The "module" may be interchangeably used with, for example, the term "unit", "logic", "logical block", "component", or "circuit". The "module" may be a minimum unit of an integrated component element or a part thereof. The "module" may be a minimum unit for performing one or more functions or a part thereof. The "module" may be mechanically or electronically implemented. For example, the "module" according to the disclosure may include at least one of an application-specific integrated circuit (ASIC) chip, a field-programmable gate array (FPGA), and a programmable-logic device for performing operations which has been known or are to be developed hereinafter.

An electronic device according to the disclosure may include at least one of, for example, a smart phone, a tablet personal computer (PC), a mobile phone, a video phone, an electronic book reader (e-book reader), a desktop PC, a laptop PC, a netbook computer, a workstation, a server, a personal digital assistant (PDA), a portable multimedia player (PMP), a MPEG-1 audio layer-3 (MP3) player, a mobile medical device, a camera, and a wearable device. The wearable device may include at least one of an accessory type (e.g., a watch, a ring, a bracelet, an anklet, a necklace, a glasses, a contact lens, or a head-mounted device (HMD)), a fabric or clothing integrated type (e.g., an electronic clothing), a body-mounted type (e.g., a skin pad, or tattoo), and a bio-implantable type (e.g., an implantable circuit).

The electronic device may be a home appliance. The home appliance may include at least one of, for example, a television, a digital video disk (DVD) player, an audio, a refrigerator, an air conditioner, a vacuum cleaner, an oven, a microwave oven, a washing machine, an air cleaner, a set-top box, a home automation control panel, a security control panel, a TV box (e.g., Samsung HomeSync™, Apple TV™, or Google TV™), a game console (e.g., Xbox™ and PlayStation™), an electronic dictionary, an electronic key, a camcorder, and an electronic photo frame.

The electronic device may include at least one of various medical devices (e.g., various portable medical measuring devices (a blood glucose monitoring device, a heart rate monitoring device, a blood pressure measuring device, a body temperature measuring device, etc.), a magnetic resonance angiography (MRA), a magnetic resonance imaging (MRI), a computed tomography (CT) machine, and an ultrasonic machine), a navigation device, a global positioning system (GPS) receiver, an event data recorder (EDR), a flight data recorder (FDR), a vehicle infotainment device, an electronic device for a ship (e.g., a navigation device for a ship, and a gyro-compass), avionics, security devices, an automotive head unit, a robot for home or industry, an automatic teller machine (ATM) in banks, point of sales (POS) devices in a shop, or an Internet of things (IoT) device (e.g., a light bulb, various sensors, electric or gas meter, a sprinkler device, a fire alarm, a thermostat, a streetlamp, a toaster, a sporting goods, a hot water tank, a heater, a boiler, etc.).

The electronic device may include at least one of a part of furniture or a building/structure, an electronic board, an electronic signature receiving device, a projector, and various kinds of measuring instruments (e.g., a water meter, an electric meter, a gas meter, and a radio wave meter). The electronic device may be a combination of one or more of the aforementioned various devices. The electronic device may also be a flexible device. Further, the electronic device is not limited to the aforementioned devices, and may include an electronic device according to the development of new technology.

Hereinafter, an electronic device will be described with reference to the accompanying drawings. In the disclosure, the term "user" may indicate a person using an electronic device or a device (e.g., an artificial intelligence electronic device) using an electronic device.

FIG. 1 is a diagram of an electronic device 101 in a network environment 100, according to an embodiment.

Referring to FIG. 1, the electronic device 101 in the network environment 100 may communicate with an electronic device 102 via a first network 198 (e.g., a short-range wireless communication network), or an electronic device 104 or a server 108 via a second network 199 (e.g., a long-range wireless communication network). The electronic device 101 may communicate with the electronic device 104 via the server 108. The electronic device 101 may include a processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. The electronic device 101 may exclude at least one component (e.g., the display device 160 or the camera module 180) or add other components. Some components may be implemented to be integrated together as if the sensor module 176 (e.g., a fingerprint sensor, an iris sensor, or an illuminance sensor) is embedded in the display device 160 (e.g., a display).

The processor 120 may drive software (e.g., a program 140) to control at least one other component (e.g., a hardware or software component) of the electronic device 101 connected with the processor 120 and may process or compute various data. The processor 120 may load and process a command or data received from another component (e.g., the sensor module 176 or the communication module 190) on a volatile memory 132, and the processor 120 may store resultant data in a non-volatile memory 134. The processor 120 may include a main processor 121 (e.g., a CPU or AP) and an auxiliary processor 123 that is operable independently from the main processor 121. In addition to, or instead of, the main processor 121, the auxiliary processor 123 may include an auxiliary processor 123 (e.g., a graphics processing unit (GPU), an image signal processor, a sensor hub processor, or a communication processor (CP)) that consumes less power than the main processor 121 or is specified for a designated function. The auxiliary processor 123 may be operated separately from or embedded in the main processor 121.

The auxiliary processor 123 may control at least some of functions or states related to at least one component (e.g., the display device 160, the sensor module 176, or the communication module 190) of the electronic device 101, instead of the main processor 121 while the main processor 121 is in an inactive (e.g., sleep) state or along with the main processor 121 while the main processor 121 is an active state (e.g., performing an application). The auxiliary processor 123 (e.g., an image signal processor or a CP) may be implemented as part of another component (e.g., the camera module 180 or the communication module 190) functionally related to the auxiliary processor 123. The memory 130 may store various data used by at least one component (e.g., the processor 120) of the electronic device 101, software (e.g., the program 140) and input data or output data for a command related to the software. The memory 130 may include the volatile memory 132 or the non-volatile memory 134.

The program 140, as software stored in the memory 130, may include an operating system (OS) 142, middleware 144, or an application 146.

The input device 150 may be a device for receiving a command or data, which is to be used for a component of the electronic device 101, from an outside (e.g., a user) of the electronic device 101. The input device 50 may include a microphone, a mouse, or a keyboard.

The sound output device 155 may be a device for outputting sound signals to the outside of the electronic device 101. The sound output device 155 may include a speaker which is used for general purposes, such as playing multimedia or recording and playing, and a receiver used for call receiving purposes only. The receiver may be formed integrally or separately from the speaker.

The display 160 may be a device for visually providing information to a user of the electronic device 101. The display device 160 may include a display, a hologram device, or a projector and a control circuit for controlling the display, hologram device, or projector. The display device 160 may include touch circuitry or a pressure sensor capable of measuring the strength of a pressure for a touch.

The audio module 170 may convert a sound into an electrical signal and vice versa. The audio module 170 may obtain a sound through the input device 150 or output a sound through the sound output device 155 or an external electronic device (e.g., an electronic device 102, a speaker or a headphone) wiredly or wirelessly connected with the electronic device 101.

The sensor module 176 may generate an electrical signal or data value corresponding to an internal operating state (e.g., power or temperature) or external environmental state of the electronic device 101. The sensor module 176 may include a gesture sensor, a gyro sensor, an atmospheric pressure sensor, a magnetic sensor, an acceleration sensor, a grip sensor, a proximity sensor, a color sensor, an infrared (IR) sensor, a bio sensor, a temperature sensor, a humidity sensor, or an illuminance sensor.

The interface 177 may support a designated protocol enabling a wired or wireless connection with an external electronic device 102. The interface 177 may include a high definition multimedia interface (HDMI), a universal serial bus (USB) interface, a secure digital (SD) card interface, or an audio interface.

A connecting terminal 178 may include a connector an HDMI connector, a USB connector, an SD card connector, or an audio connector (e.g., a headphone connector), which is able to physically connect the electronic device 101 with an external electronic device 102.

The haptic module 179 may convert an electrical signal into a mechanical stimulus (e.g., a vibration or a movement) or electrical stimulus which may be recognized by a user via his tactile sensation or kinesthetic sensation. The haptic module 179 may include a motor, a piezoelectric element, or an electric stimulator.

The camera module 180 may capture a still image or moving images. The camera module 180 may include one or more lenses, an image sensor, an image signal processor, or a flash.

The power management module 188 may be a module for managing power supplied to the electronic device 101. The power management module 188 may be configured as at least part of a power management integrated circuit (PMIC).

The battery 189 may be a device for supplying power to at least one component of the electronic device 101. The battery 189 may include a primary cell which is not rechargeable, a secondary cell which is rechargeable, or a fuel cell.

The communication module 190 may support establishing a wired or wireless communication channel between the electronic device 101 and an external electronic device (e.g., the electronic device 102, the electronic device 104, or the server 108) and performing communication through the established communication channel. The communication module 190 may include one or more communication processors that are operated independently from the processor 120 (e.g., an AP) and supports wired or wireless communication. The communication module 190 may include a wireless communication module 192 (e.g., a cellular communication module, a short-range wireless communication module, or a global navigation satellite system (GNSS) communication module) or a wired communication module 194 (e.g., a LAN communication module or a power line communication (PLC) module). A corresponding one of the wireless communication module 192 and the wired communication module 194 may be used to communicate with an external electronic device through a first network 198 (e.g., a short-range communication network, such as Bluetooth, wireless-fidelity (Wi-Fi) direct, or according to an Infrared Data Association (IrDA) standard) or a second network 199 (e.g., a long-range communication network, such as a cellular network, the Internet, or a communication network (e.g., LAN or wide area network (WAN)). The above-enumerated types of communication modules 190 may be implemented in a single chip, where at least some of the modules are integrated, or individually in separate chips.

The wireless communication module 192 may differentiate and authenticate the electronic device 101 in the communication network using user information stored in the subscriber identification module 196.

The antenna module 197 may include one or more antennas for transmitting or receiving a signal or power to/from an outside. The communication module 190 may transmit or receive a signal to/from an external electronic device through an antenna appropriate for a communication scheme.

Some of the above-described components may be connected together through an inter-peripheral communication scheme (e.g., a bus, general purpose input/output (GPIO), serial peripheral interface (SPI), or mobile industry processor interface (MIPI)), and be communicating signals (e.g., commands or data) therebetween.

Commands or data may be transmitted or received between the electronic device 101 and the external electronic device 104 via the server 108 coupled with the second network 199. The first and second external electronic devices 102 and 104 each may be a device of the same or a different type from the electronic device 101. All or some of operations executed on the electronic device 101 may be run on one or more other external electronic devices. When the electronic device 101 should perform a certain function or service automatically or at a request, the electronic device 101, instead of, or in addition to, executing the function or service on its own, may request an external electronic device to perform at least some functions associated therewith. The external electronic device receiving the request may execute the requested functions or additional functions and transfer a result of the execution to the electronic device 101. The electronic device 101 may provide a requested function or service by processing the received result as it is or additionally. To that end, a cloud computing, distributed computing, or client-server computing technique may be used.

Figure 2:
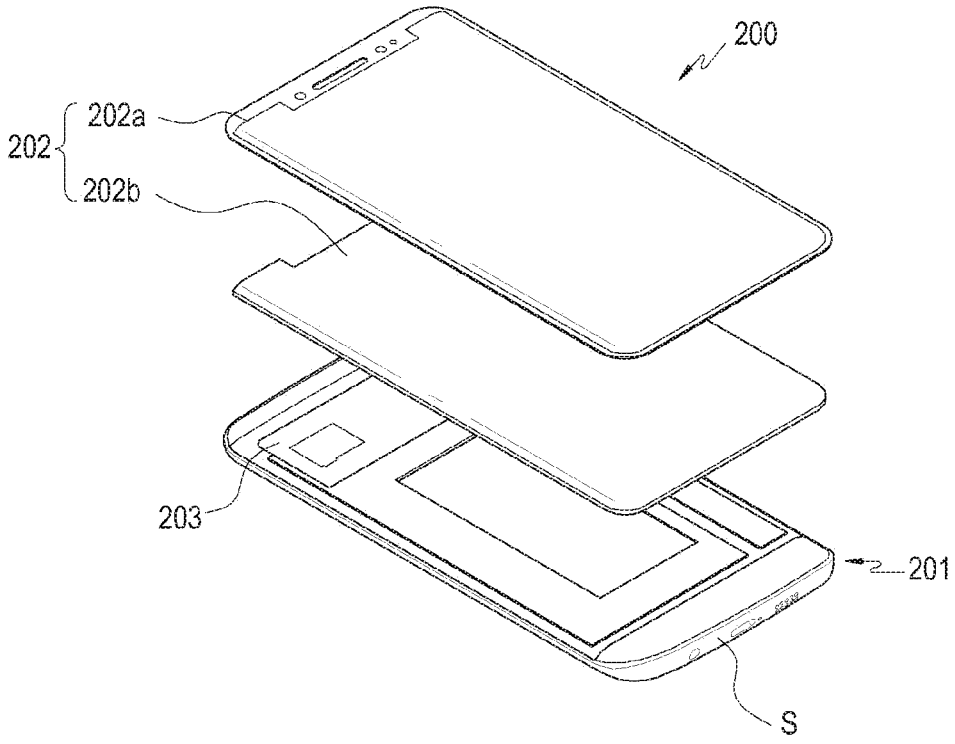
FIG. 2 is a diagram of an electronic device, according to an embodiment.

FIG. 2 is illustrating diagram of an electronic device 200, according to an embodiment.

Referring to FIG. 2, the electronic device 200 includes a casing member 201, a display device 202, and a circuit board 203. The casing member 201 may at least partially include a metal or other an electrically conductive material. At least part of a side wall S of the casing member 201 may include an electrically conductive material.

The casing member 201 may provide a space (or means) to mount or receive various parts including the display device 202 or the circuit board 203. The display device 202 may be mounted on the front surface of the casing member 201 and be received inside the casing member 201, forming the outer look of the electronic device 200, along with a portion of the casing member 201. The circuit board 203 may be received in a space between the casing member 201 and the display device 202. Alternatively, the casing member 201 may include a structure to isolate the circuit board 203 from the display device 202.

The electrically conductive portion of the casing member 201 may be utilized as an antenna device for the electronic device 200. A portion of the side wall S of the casing member 201 may be insulated from the other electrically conductive portion and be connected with the circuit board 203, the processor 120 or communication module 190, allowing it to be used as a radiating conductor. The configuration of the casing member 201 (or the configuration of a sidewall portion of the casing member 201 formed as an antenna device) are described below with reference to FIGS. 3 and 4.

The display device 202 may include a window member 202*a* and a display panel 202*b*. As a touch panel is integrated with the window member 202*a* or the display panel 202*b*, the display device 202 may be utilized as a touchscreen display. The display device 202 may be used as an input device as well as an output device to output screens.

Figure 3:
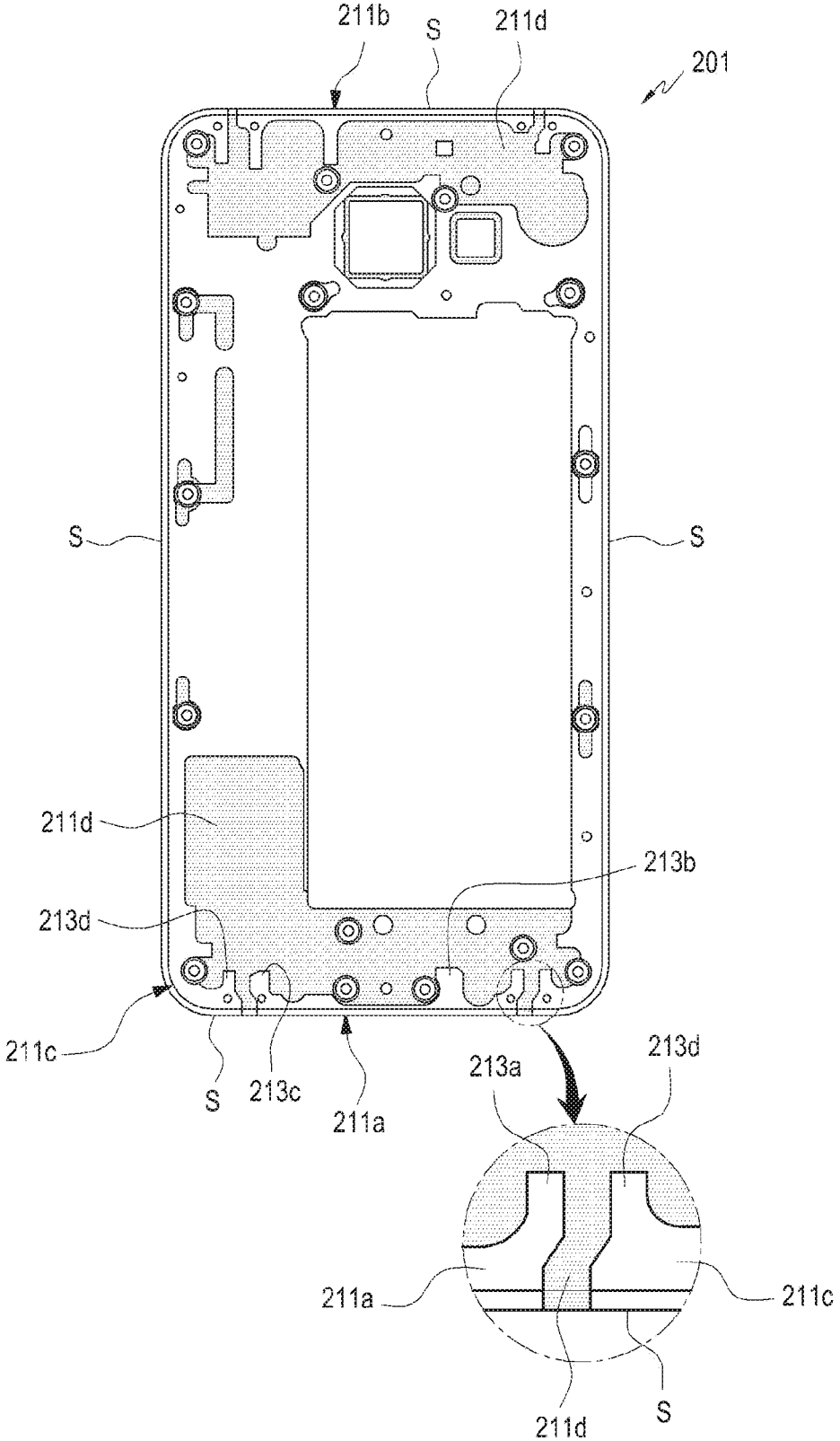
FIG. 3 is a diagram of a casing member of an electronic device, according to an embodiment.

FIG. 3 is a diagram of a casing member 201 in an electronic device, according to an embodiment.

Referring to FIG. 3, the casing member 201 is mostly formed of an electrically conductive material (e.g., a metal) and partly of an insulator 211*d*. A raw rectangular metal block is cut to a predetermined shape and polished (e.g., a first processing) by computerized numerical control (CNC) processing, then undergoes insert injection, and then forms and joins the insulator 211*d* and on a portion thereof. The insulator 211*d* formed metallic material (e.g., the metal block partially with the insulator 211*d*) is subjected to second processing, forming the casing member 201 as shown in FIG. 2. The second-processed metallic material undergoes surface polishing, washing, coloring, plating, or other various types of finishing, completing the casing member 201.

At least some of the electrically conductive portions (e.g., portions 211*a*, 211*b*, and 211*c*) of the casing member 201 may form a side wall S of the casing member 201 or a portion of the antenna device of the electronic device 200. The electrically conductive portions to be used as an antenna device may be electrically insulated from the other electrically conductive portions. The electrically conductive portion 211*a* may be insulated from the electrically conductive portion 211*c* by the insulator 211*d*. A configuration of the antenna device using the electrically conductive portion of the casing member 201 is described below in further detail in connection with FIGS. 4 and 5. An example is described below in which the portion 211*a* is utilized as a radiating conductor of an antenna device. However, embodiments of the disclosure are not limited thereto. As mentioned above, the portions 211*b* and 211*c* of the casing member 201 may contain an electrically conductive material and be electrically insulated from other electrically conductive portions, making them utilized as radiating conductors of the antenna device.

Figure 4:
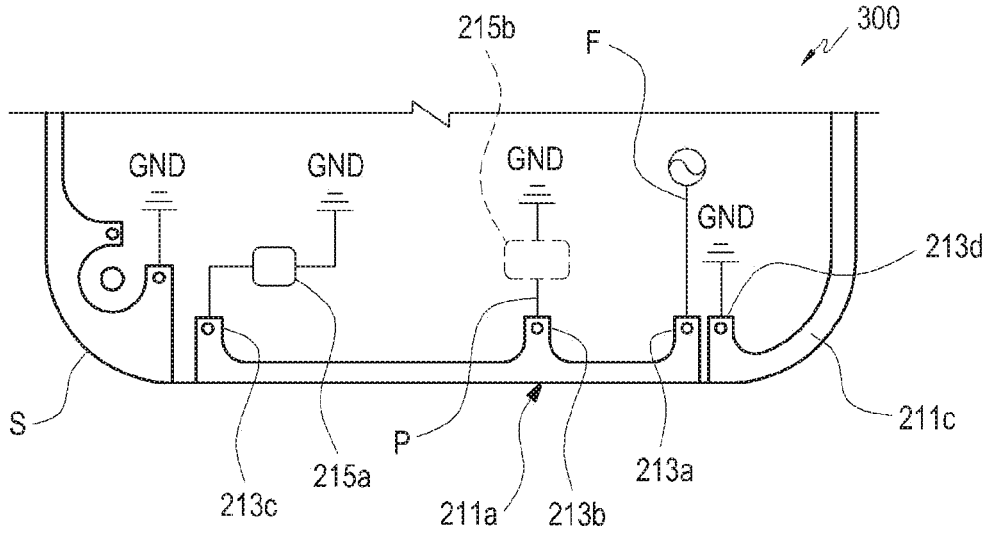
FIG. 4 is a diagram of a configuration of an antenna device in an electronic device, according to an embodiment.
Figure 5:
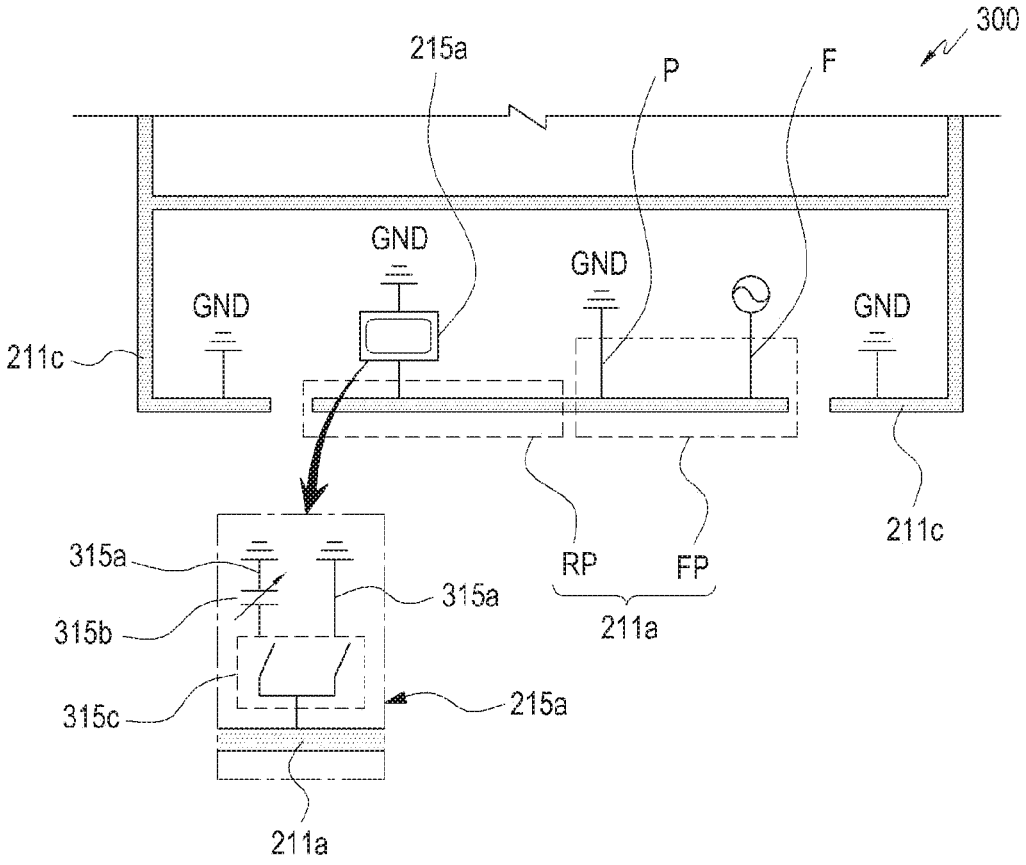
FIG. 5 is a diagram of an equivalent circuit of an antenna device in an electronic device, according to an embodiment.

FIG. 4 is a diagram of a configuration of an antenna device 300 in an electronic device according to an embodiment. FIG. 5 is a view illustrating an equivalent circuit of an antenna device 300 in an electronic device according to an embodiment.

Referring to FIGS. 4 and 5, at least some of the electrically conductive portions of the casing member 201 and/or a side wall may be connected to a communication circuit of the electronic device 200 or the ground, forming radiating conductors. Hereinafter, the portion 211*a* among the electrically conductive portions of the casing member 201 is referred to as a first radiating conductor. The antenna device 300 of the electronic device 200 may include the first radiating conductor 211*a*, a ground GND, and a first switch circuit 215*a*. The first switch circuit 215*a* may selectively connect to the first radiating conductor 211*a* or the ground. When the first switch circuit 215*a* is open, the first radiating conductor 211*a* may form at least part of an inverted-F antenna structure, and when the first switch circuit is closed, the first radiating conductor 211*a* may form at least part of a loop antenna structure. The antenna device with the first switch circuit 215*a* may form an antenna that differs in operation structure depending on whether the first switch circuit 215*a* is open or closed. The operation frequency band or resonance frequency of the antenna device 300 may be adjusted by the first switch circuit 215*a*. The first switch circuit 215*a* may include a variable capacitor 315*b*. When the first switch circuit 215*a* is in the closed state, the resonance frequency of the antenna device 300 may be adjusted depending on variations in the characteristics of the variable capacitor 315*b*.

The first radiating conductor 211*a* may be at least part of the electrically conductive portions positioned at the top or bottom of the casing member 201, forming at least part of the side wall S. The first radiating conductor 211*a* may include a feeding portion FP and a radiating portion RP. The feeding portion FP may include a feeding terminal F to receive power signals from the communication circuit of the electronic device 200 and a shorting pin P connected with the ground GND of the electronic device 200. The radiating portion RP may extend in a predetermined length from the feeding portion FP. In terms of the full length of the first radiating conductor 211*a*, the feeding terminal F and the shorting pin P may be shown to be positioned adjacent one end of the first radiating conductor 211*a*. When the first switch circuit 215*a* is in the open state, the first radiating conductor 211*a* may form at least part of an inverted-F antenna structure. The communication circuit which provides power signals to the first radiating conductor 211*a* may be prepared in an integrated circuit (IC) chip and be mounted on a circuit board, and it may be connected to the feeding terminal F via a printed circuit pattern formed on the circuit board 203, various cables or flexible printed circuit board, and C-clips. The feeding terminal F may include a feeding protrusion 213*a* that projects from the first radiating conductor 211*a* to the inside of the casing member 201. The feeding protrusion 213*a* may be formed at or adjacent the one end of the first radiating conductor 211*a* to electrically or mechanically connect, or bring in contact, the communication circuit with the first radiating conductor 211*a*.

The ground GND may connect to the first radiating conductor 211*a* via the shorting pin P, providing a reference potential for the first radiating conductor 211*a*. The ground GND may include a ground conductor provided for the circuit board 203 or another electrically conductive portion of the casing member 201 and be connected with the shorting pin P via the printed circuit pattern formed on the circuit board 203, various cables or flexible printed circuit board, or C-clips. The shorting pin P may include a shorting protrusion 213*b* that projects from the first radiating conductor 211*a* to the inside of the casing member 201. The shorting protrusion 213*b* may be formed adjacent the feeding protrusion 213*a* and may electrically or mechanically connect, or bring in contact, the ground GND with the first radiating conductor 211*a*.

The first switch circuit 215*a* is provided on the radiating portion RP side to selectively connect the first radiating conductor 211*a* (e.g., the radiating portion RP) to the ground GND. On the casing member 201, the first switch circuit 215*a* is disposed apart from the feeding terminal F or the shorting pin P by a predetermined interval, forming a stable loop antenna structure. When the first switch circuit 215*a* is in the closed state, the first switch circuit 215*a* may be disposed apart from the feeding terminal F by an interval of a half or more of the resonance frequency wavelength of the loop antenna structure. The first switch circuit 215*a* may include a connection protrusion 213*c* that projects from the first radiating conductor 211*a* to the inside of the casing member 201. The connection protrusion 213*c* may be formed at or adjacent the other end of the first radiating conductor 211*a* to electrically or mechanically connect, or bring in contact, the ground GND with the first radiating conductor 211*a*.

The ground GND connected with the shorting pin P and the ground GND connected with the first switch circuit 215*a* may be provided as a substantially common ground. When the first switch circuit 215*a* is closed, part of the first radiating conductor 211*a*, the first switch circuit 215*a*, the common ground, and the shorting pin P may electrically form a loop structure. When the first switch circuit 215*a* is in the closed state, the feeding terminal F may supply power signals to the loop structure. Wireless signals may be transmitted or received via the loop antenna structure that includes at least part of the first radiating conductor 211*a*.

The electronic device 200 may utilize another portion (e.g., the portion 211*c*) of the electrically conductive portions of the casing member 201 as another radiating conductor (e.g., a second radiating conductor 211*c*). The second radiating conductor 211*c* may form another portion of the side wall S of the casing member 201 and be disposed adjacent one end or each of both ends of the first radiating conductor 211*a*. Where the second radiating conductor 211*c* is disposed adjacent one end or each of both ends of the first radiating conductor 211*a*, part of the insulator 211*d* may be disposed between the first radiating conductor 211*a* and the second radiating conductor 211*c*. The insulator 211*d* may insulate the second radiating conductor 211*c* from the first radiating conductor 211*a*. Part of the insulator 211*d* may form another portion of the side wall S between the first radiating conductor 211*a* and the second radiating conductor 211*c*. The second radiating conductor 211*c* may include another ground protrusion 213*d* formed in at least one position. The second radiating conductor 211*c* may be connected to the ground GND via the other ground protrusion 213*d*, forming an additional antenna structure. The second radiating conductor 211*c* may receive power signals from the communication circuit via a feeding terminal provided separately.

The first switch circuit 215*a* may have a single pole double throw (SPDT) switch structure. The first switch circuit 215*a* may include a plurality of first electrical paths 315*a*. When the first switch circuit 215*a* is in the closed state, a switch element 315*c* may be used to select one of the plurality of first electrical paths 315*a*, connecting the radiating portion RP or the first radiating conductor 211*a* to the ground GND. When the first switch circuit 215*a* is in the open state, the first radiating conductor 211*a* may form at least part of an inverted-F antenna structure. When the first switch circuit 215*a* is in the closed state, the first radiating conductor 211*a* may form at least part of a loop antenna structure, and the resonance frequency of the first radiating conductor 211*a* may be adjusted by the path (e.g., one of the plurality of first electrical paths 315*a*) selected by the first switch circuit 215*a*.

At least one of the plurality of first electrical paths 315*a* may include a variable capacitor 315*b*. Where the first radiating conductor 211*a* forms at least part of a loop antenna structure, and the variable capacitor 315*b* is disposed on the first path selected by the first switch circuit 215*a*, the resonance frequency of the first radiating conductor 211*a* may be adjusted by the capacitance of the variable capacitor 315*b*. As the capacitance of the variable capacitor 315*b* increases, the resonance frequency of the first radiating conductor 211*a* may decrease.

The resonance frequency of the first radiating conductor 211*a* may be adjusted in various ranges depending on the number of the first paths 315*a* in the first switch circuit 215*a* or the number or specifications of variable capacitors 315*b* to be disposed. Although the first switch circuit 215*a* and one variable capacitor 315*b* of an SPDT switch structure are provided in the instant embodiment, the first switch circuit 215*a* may alternatively include two (or more) first paths on each of which a variable capacitor is disposed and at least one first path on which no variable capacitor is disposed. Where, among the variable capacitors, one has a capacitance variable from 0 pF to 1 pF, and the other a capacitance variable from 0 pF to 3 pF, the range in which the resonance frequency of the first radiating conductor 211*a* is adjusted may be varied depending on the first path selected and connected by the first switch circuit 215*a* or the specification or capacitance of the variable capacitor disposed on the corresponding path.

The antenna device 300 and/or the electronic device 200 may add a second switch circuit 215*b* that is provided as part of the shorting pin P. The second switch circuit 215*b* may have a similar structure to the first switch circuit 215*a*. The second switch circuit 215*b* may include a plurality of second electrical paths between the shorting pin P (e.g., the shorting protrusion 213*a*) and the ground GND and may connect the first radiating conductor 211*a* to the ground GND via one selected from among the plurality of second electrical paths. At least part of each path included in the second switch circuit 215*b* may have a matching circuit or a tuning circuit.

When the first switch circuit 215*a* is in the open state, the communication circuit of the electronic device 200 may be configured to transmit or receive wireless signals in a first frequency band using the antenna device 300 (e.g., the first radiating conductor 211*a*). When the first switch circuit 215*a* is in the open state, the first radiating conductor 211*a* may form at least part of an inverted-F antenna structure, producing a resonance frequency in a range from about 0.70 GHz to about 0.90 GHz. Where the shorting pin P includes the second switch circuit 215*b*, the resonance frequency of the first radiating conductor 211*a* may be adjusted in the first frequency band (e.g., a frequency range from about 0.70 GHz to about 0.90 GHz).

When the first switch circuit 215*a* is in the closed state, the communication circuit of the electronic device 200 may be configured to transmit or receive wireless signals in a second frequency band using the first radiating conductor 215*a*. The second frequency band may be lower than the first frequency band, may be a frequency range from about 0.60 GHz to about 0.70 GHz. Where the first switch circuit 215*a* includes a plurality of electrical connection paths, the resonance frequency formed in the second frequency band may be adjusted depending on the path selected by the first switch circuit 215*a*. Alternatively, where a variable capacitor is disposed on the path selected by the first switch circuit 215*a*, the resonance frequency formed in the second frequency band may be adjusted by the capacitance of the variable capacitor.

Figure 6:
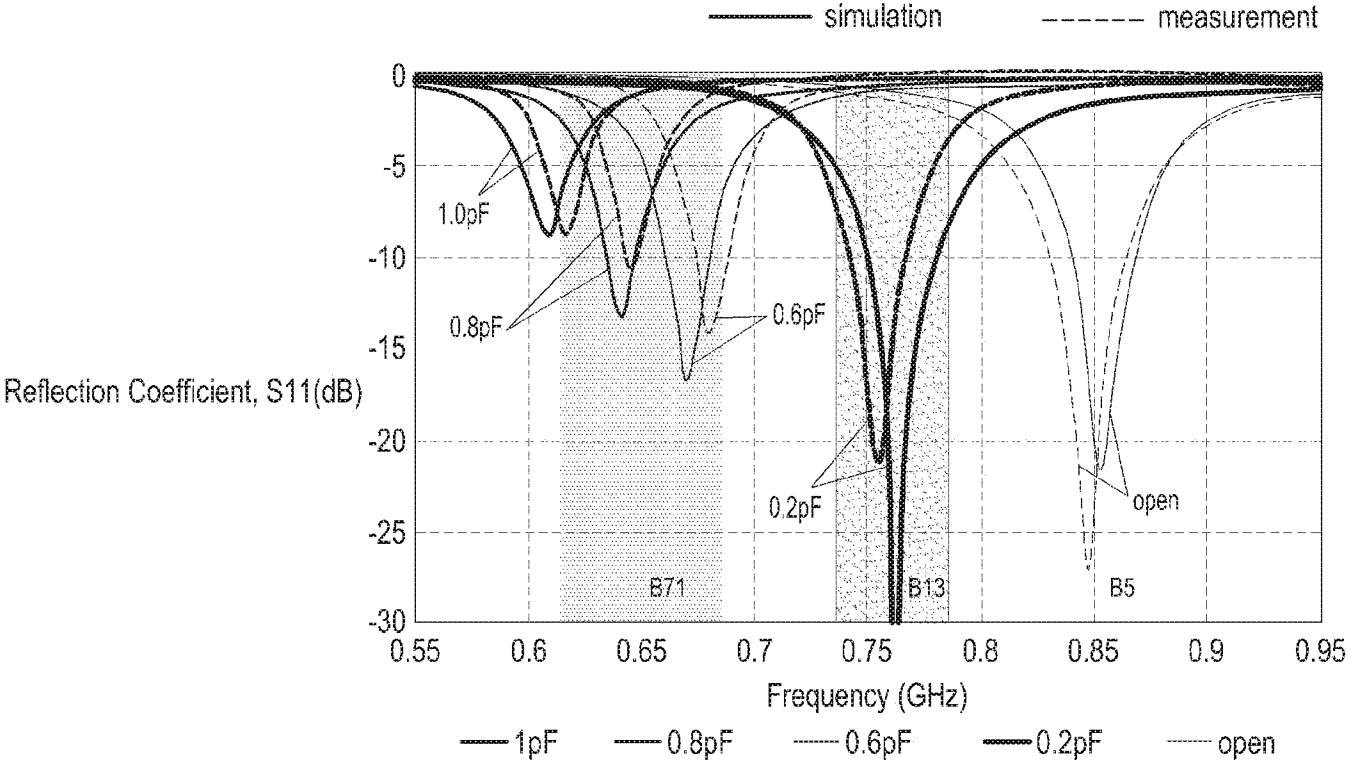
FIG. 6 is a graph of reflection coefficients measured on an antenna device in an electronic device, according to an embodiment.

FIG. 6 is a graph of reflection coefficients S11 measured on an antenna device in an electronic device, according to an embodiment.

Referring to FIG. 6, "open" denotes the respective graphs of the simulation and actual measurement of the reflection coefficient (S-parameter, S11) when the first switch circuit is in the open state, and "0.2p", "0.6 pF", "0.8 pF", and "1 pF" each denote the simulated and actually measured reflection coefficients S11 depending on the capacitance of the variable capacitor when the first switch circuit is in the open state.

When the first switch circuit 215*a* is open, the antenna device 300 may form an inverted-F antenna structure that includes at least part of the first radiating conductor 211*a*. It may be shown that while the first switch circuit 215*a* is open to form an inverted-F antenna structure, the antenna device 300 produces a resonance frequency of about 0.85 GHz. Where the shorting pin P includes a second switch circuit and the first switch circuit 215*a* is in the open state, the resonance frequency of the antenna device 300 may be adjusted in a range from about 0.70 GHz to about 0.90 GHz depending on the path selected by the second switch circuit 215*b*.

When the first switch circuit 215*a* is closed, the antenna device 300 may form a loop antenna structure that includes at least part of the first radiating conductor 211*a*. When the first switch circuit 215*a* connects the first radiating conductor 211*a* to the ground GND apart from the feeding terminal by a predetermined interval, the antenna device 300 may operate as a loop antenna. When a variable capacitor is disposed on the path selected and connected by the first switch circuit 215*a*, the resonance frequency of the antenna device 300 may be adjusted by controlling the capacitance. As the capacitance of the variable capacitor 315*b* increases up to 1 pF, the resonance frequency of the first radiating conductor 211*a* and/or the antenna structure formed to include the first radiating conductor 211*a* gradually decrease—the resonance frequency gradually reduces from about 0.76 GHz to about 0.61 GHz. Where the first switch circuit 215*a* is closed to form a loop antenna structure, and a variable capacitor 315*b* is disposed on the path selected (or connected) by the first switch circuit 215*a*, the resonance frequency of the antenna device 300 may be adjusted by controlling the capacitance of the variable capacitor 315*b*.

When the first switch circuit 215*a* is in the closed state, the resonance frequency may be adjusted by the second switch circuit 215*b* which is provided as part of the shorting pin P. The second switch circuit 215*b* may include a plurality of second paths, and the resonance frequency may be adjusted by the connection path between the shorting protrusion 213*b* and the ground GND by the second switch circuit 215*b*.

The first switch circuit 215*a* may add an electrical path to the radiating conductor of a predetermined shape or selectively form antenna structures of different shapes. When the first switch circuit 215*a* is in the open state, the antenna device may operate as an antenna structure (e.g., an inverted-F antenna structure) that is formed by the radiating conductor itself, and when the first switch circuit 215*a* is in the closed state, the antenna device 300 may include at least part of the radiating conductor, forming a loop antenna structure. When the first switch circuit 215*a* is in the closed state, the resonance frequency of the radiating conductor may be lower than when the first switch circuit 215*a* is in the open state. The variable capacitor 315*b* may be disposed on at least one of the plurality of electrical paths that the first switch circuit 215*a* provides, and the first switch circuit 215*a* may connect the radiating conductor to the ground GND via the path that has the variable capacitor 315*b*. In this case, the loop antenna structure-based resonance frequency may be adjusted by controlling the capacitance of the variable capacitor 315*b*. As the capacitance of the variable capacitor increases, the resonance frequency formed by the loop antenna structure may decrease. The capacitance of the variable capacitor may be controlled by the communication circuit of the electronic device.

The antenna device or electronic device may adjust the resonance frequency of the antenna device using a switch circuit including a variable capacitor and secure a resonance frequency in an additional frequency band even without changing the shape of the radiating conductor. It enables communication in a wider frequency band by arranging the switch circuits while substantially maintaining the shape or deployment of the antenna device. The above-described antenna device or electronic device enables ultra high-rate, high-volume wireless communication by way of CA technology in a wider frequency band.

According to an embodiment, an antenna device and/or an electronic device including the antenna device may include a first radiating conductor including a feeding portion and a radiating portion extending from the feeding portion, the feeding portion including a feeding terminal and a shorting pin, a ground electrically connected with the first radiating conductor via the shorting pin and configured to provide a reference potential for the first radiating conductor, and a first switch circuit provided on a side of the radiating portion and configured to selectively connect the radiating portion with the ground. The first radiating conductor may be configured to form at least part of an inverted-F antenna structure when the first switch circuit is open and to form at least part of a loop antenna structure when the first switch circuit is closed.

The first radiating conductor may be configured to produce a resonance frequency in a first frequency band when the first switch circuit is open and to produce the resonance frequency in a second frequency band lower than the first frequency band when the first switch circuit is closed.

The first switch circuit may include a plurality of first electrical paths between the radiating portion and the ground, and in a closed state of the first switch circuit, the first switch circuit may be configured to select one of the plurality of first electrical paths to connect the radiating portion to the ground.

The first switch circuit may include a plurality of first electrical paths between the radiating portion and the ground and a variable capacitor disposed on at least one of the plurality of first electrical paths, and in a closed state of the first switch circuit, the first switch circuit may be configured to select one of the plurality of first electrical paths to connect the radiating portion to the ground.

When the radiating portion is connected to the ground via the first electrical path where the variable capacitor is disposed, the loop antenna structure may be configured to produce a resonance frequency that decreases as a capacitance of the variable capacitor increases.

The antenna device may further include a second switch circuit disposed as part of the shorting pin between the first radiating conductor and the ground.

The second switch circuit may include a plurality of second electrical paths between the shorting pin and the ground, and the second switch circuit may be configured to select one of the plurality of second electrical paths to connect the first radiating conductor to the ground.

According to an embodiment, an electronic device may include a casing member including a side wall, the side wall at least partially including an electrically conductive material and an antenna device configured to transmit or receive a wireless signal. The antenna device may include a first radiating conductor formed as a portion of the side wall, a ground configured to provide a reference potential for the first radiating conductor, a feeding terminal disposed at or adjacent a first end of the first radiating conductor, a first switch circuit disposed at or adjacent a second end of the first radiating conductor and configured to selectively connect the first radiating conductor to the ground, and a shorting pin disposed adjacent the feeding terminal between the feeding terminal and the second end of the first radiating conductor and configured to electrically connect the first radiating conductor to the ground. The first radiating conductor may be configured to form at least part of an inverted-F antenna structure when the first switch circuit is open and to form at least part of a loop antenna structure when the first switch circuit is closed.

The first switch circuit may include a plurality of first electrical paths between the first radiating conductor and the ground and a variable capacitor disposed on at least one of the plurality of first electrical paths, and in a closed state of the first switch circuit, the first switch circuit may be configured to select one of the plurality of first electrical paths to connect the first radiating conductor to the ground.

When the first radiating conductor is connected to the ground via the first electrical path where the variable capacitor is disposed, the loop antenna structure may be configured to produce a resonance frequency that decreases as a capacitance of the variable capacitor increases.

The electronic device may further include a processor or a communication circuit connected with the antenna device, and the processor or the communication circuit may be configured to transmit or receive the wireless signal in a first frequency band using the first radiating conductor in an open state of the first switch circuit and to transmit or receive the wireless signal in a second frequency band lower than the first frequency band using the first radiating conductor in the closed state of the first switch circuit.

The antenna device may further include a second switch circuit disposed as part of the shorting pin between the first radiating conductor and the ground.

The second switch circuit may include a plurality of second electrical paths between the shorting pin and the ground and the second switch circuit may be configured to select one of the plurality of second electrical paths to connect the first radiating conductor to the ground.

As the second switch circuit selects one of the plurality of second electrical paths to connect the shorting pin to the ground in the open state of the first switch circuit, a resonance frequency may be adjusted in the first frequency band.

The feeding terminal may include a feeding protrusion that is provided at or adjacent the first end of the first radiating conductor and that projects from the first radiating conductor to an inside of the casing member, and the shorting pin may include a shorting protrusion that is provided adjacent the feeding protrusion and that projects from the first radiating conductor to the inside of the casing member.

The first switch circuit may include a connection protrusion that is provided at or adjacent the second end of the first radiating conductor and that projects from the first radiating conductor to an inside of the casing member.

The antenna device may further include a second radiating conductor formed as a portion of the side wall, and the second radiating conductor may be disposed adjacent at least one of both ends of the first radiating conductor.

The antenna device may further include an insulator between the first radiating conductor and the second radiating conductor, and the insulator may be formed as another portion of the side wall.

The shorting pin may form a portion of the loop antenna structure when the first switch circuit is in the closed state.

The first switch circuit may include a variable capacitor, and the first switch circuit may be configured to, along with the first radiating conductor and the shorting pin, form at least part of the loop antenna structure when the first switch circuit is closed.

According to an embodiment, a switch circuit to selectively connect a radiating conductor with the ground may be used to change the electrical length of the radiating conductor and/or an antenna operation structure implemented by the radiating conductor. An antenna device and/or an electronic device including the antenna device may easily adjust the resonance frequency, thereby securing the resonance frequency in more frequency bands and hence contributing to implementing enhanced CA technology. Such switch circuits may easily be added even without changing the mechanical structure of the radiating conductor, saving costs for designing the electronic device. Where the switch circuit includes a switching element and a variable capacitor, the switch circuit may adjust the resonance frequency more easily by use of the variable capacitor.

Although mentioned in the above examples are resonance frequencies, or frequency bands where resonance frequencies are formed, following the arrangement of the first switch element or other elements or their operations, such resonance frequencies or frequency bands where they are formed may properly be set depending on the structure, specifications, or actual use environment of a real antenna device to be manufactured or an electronic device including the antenna device.

While the disclosure has been shown and described with reference to certain embodiments thereof, it will be understood by those skilled in the art that various changes in form and details may be made therein without departing from the scope of the disclosure. Therefore, the scope of the disclosure should not be defined as being limited to the embodiments, but should be defined by the appended claims and equivalents thereof.

What is claimed is:

1. An antenna device, comprising:

a first radiating conductor including a feeding portion and a radiating portion extending from the feeding portion, the feeding portion including a feeding terminal and a shorting pin;

a ground electrically connected with the first radiating conductor via the shorting pin and configured to provide a reference potential for the first radiating conductor; and a first switch circuit provided on a side of the radiating portion and configured to selectively connect the radiating portion with the ground, wherein the first radiating conductor is configured to form at least part of an inverted-F antenna structure when the first switch circuit is open, and the first radiating conductor and the shorting pin are configured to form at least part of a loop antenna structure when the first switch circuit is closed.

2. The antenna device of claim 1, wherein the first radiating conductor is further configured to produce a resonance frequency in a first frequency band when the first switch circuit is open and to produce the resonance frequency in a second frequency band lower than the first frequency band when the first switch circuit is closed.

3. The antenna device of claim 1, wherein the first switch circuit includes a plurality of first electrical paths between the radiating portion and the ground, and wherein, in a closed state of the first switch circuit, the first switch circuit is configured to select one of the plurality of first electrical paths to connect the radiating portion to the ground.

4. The antenna device of claim 1, wherein the first switch circuit includes:

a plurality of first electrical paths between the radiating portion and the ground, and a variable capacitor disposed on at least one of the plurality of first electrical paths, and wherein, in a closed state of the first switch circuit, the first switch circuit is configured to select one of the plurality of first electrical paths to connect the radiating portion to the ground.

5. The antenna device of claim 4, wherein, when the radiating portion is connected to the ground via the first electrical path where the variable capacitor is disposed, the loop antenna structure is configured to produce a resonance frequency that decreases as a capacitance of the variable capacitor increases.

6. The antenna device of claim 1, further comprising a second switch circuit disposed as part of the shorting pin between the first radiating conductor and the ground.

7. The antenna device of claim 6, wherein the second switch circuit includes a plurality of second electrical paths between the shorting pin and the ground, and wherein the second switch circuit is configured to select one of the plurality of second electrical paths to connect the first radiating conductor to the ground.

8. An electronic device, comprising:

a casing member including a side wall, the side wall at least partially including an electrically conductive material; and an antenna device configured to transmit or receive a wireless signal, the antenna device including:

a first radiating conductor formed as a portion of the side wall, a ground configured to provide a reference potential for the first radiating conductor, a feeding terminal disposed at or adjacent a first end of the first radiating conductor, a first switch circuit disposed at or adjacent a second end of the first radiating conductor and configured to selectively connect the first radiating conductor to ground and a shorting pin disposed adjacent to the feeding terminal between the feeding terminal and the second end of the first radiating conductor and configured to electrically connect the first radiating conductor to the ground, wherein the first radiating conductor is configured to form at least part of an inverted-F antenna structure when the first switch circuit is open, and the first radiating conductor and the shorting pin are configured to form at least part of a loop antenna structure when the first switch circuit is closed.

9. The electronic device of claim 8, wherein the first switch circuit includes a plurality of first electrical paths between the first radiating conductor and the ground, and a variable capacitor disposed on at least one of the plurality of first electrical paths, and wherein in a closed state of the first switch circuit, the first switch circuit is configured to select one of the plurality of first electrical paths to connect the first radiating conductor to the ground.

10. The electronic device of claim 9, wherein, when the first radiating conductor is connected to the ground via the first electrical path where the variable capacitor is disposed, the loop antenna structure is configured to produce a resonance frequency that decreases as a capacitance of the variable capacitor increases.

11. The electronic device of claim 8, further comprising one of a processor and a communication circuit connected with the antenna device, wherein the one of the processor and the communication circuit is configured to:

transmit or receive the wireless signal in a first frequency band using the first radiating conductor in an open state of the first switch circuit, and transmit or receive the wireless signal in a second frequency band lower than the first frequency band using the first radiating conductor in the closed state of the first switch circuit.

12. The electronic device of claim 11, wherein the antenna device further includes a second switch circuit disposed as part of the shorting pin between the first radiating conductor and the ground.

13. The electronic device of claim 12, wherein the second switch circuit includes a plurality of second electrical paths between the shorting pin and the ground, and wherein the second switch circuit is configured to select one of the plurality of second electrical paths to connect the first radiating conductor to the ground.

14. The electronic device of claim 13, wherein, as the second switch circuit selects one of the plurality of second electrical paths to connect the shorting pin to the ground in the open state of the first switch circuit, a resonance frequency is adjusted in the first frequency band.

15. The electronic device of claim 8, wherein the feeding terminal includes a feeding protrusion that is provided at or adjacent the first end of the first radiating conductor and that projects from the first radiating conductor to an inside of the casing member, and wherein the shorting pin includes a shorting protrusion that is provided adjacent the feeding protrusion and that projects from the first radiating conductor to the inside of the casing member.

16. The electronic device of claim 8, wherein the first switch circuit includes a connection protrusion that is provided at or adjacent to the second end of the first radiating conductor and that projects from the first radiating conductor to an inside of the casing member.

17. The electronic device of claim 8, wherein the antenna device further includes a second radiating conductor formed as a portion of the side wall, and wherein the second radiating conductor is disposed adjacent to at least one of the ends of the first radiating conductor.

18. The electronic device of claim 17, wherein the antenna device further includes an insulator between the first radiating conductor and the second radiating conductor, and wherein the insulator is formed as another portion of the side wall.

19. The electronic device of claim 8, wherein the first switch circuit includes a variable capacitor, and wherein the first switch circuit is configured to, along with the first radiating conductor and the shorting pin, form at least part of the loop antenna structure when the first switch circuit is closed.

* * * * *